United States Patent [19]

McGraw et al.

[11] Patent Number: 4,959,169

[45] Date of Patent: Sep. 25, 1990

[54] ESTERIFIED POLYGLYCOL LUBRICANTS FOR REFRIGERATION COMPRESSORS

[75] Inventors: Philip W. McGraw, Lake Jackson; Eldon L. Ward, Angleton; Michael W. Edens, Lake Jackson, all of Tex.

[73] Assignee: The Dow Chemical Company, Midland, Mich.

[21] Appl. No.: 425,621

[22] Filed: Oct. 20, 1989

[51] Int. Cl.[5] ..... C10M 105/34; C10M 105/38

[52] U.S. Cl. ..... 252/68; 62/114

[58] Field of Search ..... 252/68; 62/114

[56] References Cited

U.S. PATENT DOCUMENTS

| | | | |
|---|---|---|---|
| 4,248,726 | 2/1981 | Uchinums et al. | 252/52A |
| 4,267,064 | 5/1981 | Sasaki et al. | 252/52A |
| 4,302,343 | 11/1981 | Carswell et al. | 252/33.4 |
| 4,428,854 | 1/1984 | Enjo et al. | 252/69 |
| 4,431,557 | 2/1984 | Shimizu et al. | 252/52A |
| 4,454,052 | 6/1984 | Shoji et al. | 252/68 |
| 4,751,012 | 6/1988 | Ward et al. | 252/52A |
| 4,755,316 | 7/1988 | Magid et al. | 252/68 |
| 4,851,144 | 7/1989 | McGraw et al. | 252/52A |

FOREIGN PATENT DOCUMENTS

| | | | |
|---|---|---|---|
| 59-21632 | 2/1984 | Japan | 252/68 |

OTHER PUBLICATIONS

Research Disclosure #17463; Research Disclosure, Oct. 1978.

H. H. Druse et al., "Fundamentals of Lubrication in Refrigerating Systems and Heat Pumps", pp. 763–783, ASHRAE Transactions, vol. 90, Part 2B, 1984.

K. S. Sanvordenker et al., "A Review of Synthetic Oils for Refrigeration Use", ASHRAE Symposium, Nassau, Jun. 19, 1972.

*Primary Examiner*—Olik Chaudhuri

*Assistant Examiner*—Jerry D. Johnson

[57] ABSTRACT

Refrigeration fluid compositions for compression refrigeration which have an upper solution critical temperature equal to or greater than about 35° C. are composed of selected hydrochlorofluorocarbons and hydrofluorocarbons with esterified polyether polyols in which at least 30% of the hydroxyls are esterified. The esterified polyether polyols have a viscosity between 25 and 150 centistokes at 38° C.

24 Claims, No Drawings

ESTERIFIED POLYGLYCOL LUBRICANTS FOR REFRIGERATION COMPRESSORS

FIELD OF THE INVENTION

This invention relates to compositions of esterified polyglycols with hydrofluorocarbon and hydrochlorofluorocarbon refrigerants which are useful for lubricating compression refrigeration equipment such as heat pumps and air conditioning compressors.

Refrigerant R12 (dichlorodifluoromethane), is used in automotive air conditioners and many other types of refrigeration and air conditioning compressors. It is a chlorofluorocarbon that has been identified as depleting atmospheric ozone. The Montreal Protocol restricts the production of R12 beginning in 1992. Refrigerant R134a (1,1,1,2-tetrafluoroethane) has a vapor pressure very similar to R12 and has the advantage that it does not deplete atmospheric ozone. R134a can replace R12 in most refrigeration systems without major redesign of present equipment. It could be used in automotive air conditioners without any re-tooling by the automotive companies. The major problem of using R134a is that conventional lubricants such as naphthenic mineral oils are not soluble over the temperature range −20° to 100° C., the operating temperatures encountered in the different refrigeration applications. Some polyglycols are soluble in R134a at 25° C. and below but phase separate as the temperature increases. Phase separation of the lubricant from the refrigerant can cause poor lubricant return to the compressor. This results in poor lubrication of the compressor with the concurrent increased wear and decreased compressor life.

Surprisingly, it has been found that the esters of certain polyglycols are more soluble in refrigerant 134a (R134a) than their polyglycol precursors. Some polyglycols are soluble in R134a at low temperatures but phase separate as the temperature increases. The temperature of phase separation is called the upper solution critical temperature (USCT) and is reported in degrees Celsius. To provide effective lubrication to an air conditioning or refrigeration compressor the lubricant must be soluble at all operating temperatures. This discovery increases the range of lubricant solubility over that presented in the prior known art. These esterified polyglycol can be used to formulate lubricants for R134a and other hydrofluorocarbon refrigerants that will offer compressor manufacturers a broader temperature range in which to design compressors. The usefulness of this invention is that it will enable compressor manufacturers to substitute R134a and other hydrofluorocarbons or hydrochlorofluorocarbons for chlorofluorocarbons such as R12 in most compressors without mechanical modification to existing compressors and be able to operate over a broad temperature range.

DESCRIPTION OF THE PRIOR ART

The fundamentals of lubrication in air conditioners are set forth by H. H. Kruse et al. in "Fundamentals of Lubrication in Refrigeration Systems and Heat Pumps" pages 763–783; ASHRAE Transactions Vol 90 part 2B (1984). This reference is incorporated by reference herein.

Lubricants for various refrigeration compressors are known from U.S. Pat. No. 4,248,726. This patent shows polyether polyols or polyglycols with functionalities of 1 to 6 are useful as refrigeration lubricants with various refrigerants such as R11, R12, R22 and the like. The polyglycols can have free OH groups or can be ether or ester capped and they contain an acid scavenging additive package. These fluids must have a viscosity of 50 to 200 cs at 98.8° C. and a viscosity index of at least 150. The focus of this patent is an additive package that prevents the degradation of the high viscosity polyglycols in a compressor type refrigerator. The viscosity of these lubricants are higher than the lubricants of the present invention and they are not soluble in R134a at elevated temperatures.

U.S. Pat. No. 4,267,064 shows essentially the same invention as the above U.S. Pat. No. 4,248,726 patent except that the '064 patent discloses and teaches the use of polyether polyols having viscosities of 25 to 50 cs at 98.8° C. The viscosity of these lubricants are higher than the lubricants of the present invention and they are not soluble in R134a at elevated temperatures.

U.S. Pat. No. 4,755,316 discloses compositions containing one or more polyether polyols for lubricating refrigeration compressors using R134a. The fluids of this patent are all hydroxyl terminated. Several esters were cited as being unsuitable as lubricants for R134a because they are insoluble at elevated temperatures (35° C. or more).

U.S. Pat. No. 4,851,144 discloses mixtures of polyether polyols such as a polypropylene glycol and certain polyol esters such as pentaerythritol tetraester which have high USCT's in R134a. As will be shown later, the esterified polyether polyols of the present invention surprisingly have USCT's higher than would be expected by mixing an amount of ester with the polyether polyol such that each fluid has an equal amount of ester functionality.

Lubricants for various refrigeration compressors are also known from Japanese patent J No. 57/051795. This patent suggests that a high molecular weight polypropylene glycol based on glycerine might be useful as a refrigeration lubricant. However, these polyglycols are insoluble in R134a at room temperature.

SUMMARY OF THE INVENTION

The invention comprises refrigerant/lubricant fluid compositions which have upper solution critical temperatures equal to or greater than about 35° C. comprising hydrofluorocarbon and hydrochlorofluorocarbon refrigerants with esterified polyether polyols.

In general, the compositions consist of (A) a refrigerant selected from the group consisting of hydrofluorocarbons and hydrochlorofluorocarbons, and (B) a lubricant composition which has a viscosity between 25 and 150 centistokes at 38° C. and which comprises esterified polyether polyols where greater than about 30%, preferably greater than about 60% and most preferably about 95 to about 100% of the hydroxyl groups are esterified and wherein said esterified polyether polyols have the formula $$Z—[(CH_2—CH(R_1)—O—)_n—(CH_2—CH(CH_3)—O—)_m—R_2]_p$$

where

Z is the residue of a compound having 1–8 active hydrogens and preferably about 1–4 active hydrogens, $R_1$ is hydroqen, ethyl, or mixtures thereof, $R_2$ is an alkanoyl group of 2 to 6 carbon atoms or hydrogen, n is 0 or a positive number, m is a positive number, n+m is a number having a value which will give an esterified polyether polyol with a number average molecular weight range from about 400 to about 2500, p is an integer having a value equal to the number of active hydrogens of Z.

A preferred composition of this invention is a fluid composition comprising 1,1,1,2-tetrafluoroethane (R134a) and about 1 to about 75% by weight of a lubricant such as polypropylene glycol having a number average molecular weight of from about 400 to about 1500 with about 95% or more of the free hydroxyl groups esterified with alkanoyl groups of 2 to 6 carbon atoms and particularly acetate groups or propionate groups.

DETAILED DESCRIPTION OF THE INVENTION

Examples of the precursor polyether polyols or polyoxyalkylene polyols used in this invention are those derived from ethylene oxide, propylene oxide, 1,2-butylene oxide or 2,3-butylene oxide. The above oxides may be polymerized alone, i.e., homopolymerized or in combination. The combined oxides may also be combined in a random or block addition. Compounds of a hydrophobic nature are preferred, such as those derived from propylene oxide, butylene oxides or combinations thereof.

Examples of suitable polyoxyalkylene glycols are those derived from ethylene, propylene, and butylene oxides wherein the alkylene oxides are initiated from a compound having 1 to 8 active hydrogens in a known manner. These polyether polyols and their preparation are well known from the book "Polyurethanes" by Saunders and Frisch, Interscience Publishers (1962), pages 33–39. This book is incorporated by reference herein.

Examples of suitable initiator compounds which are employed to prepare the above polyether polyols are compounds having 1–8 active hydrogens such as for example n-butanol, ethylene glycol, propylene glycol, water, glycerine, pentaerythritol, ethylene diamine, diethylene triamine, and sorbitol.

The foregoing precursor polyether polyols should have a number average molecular weight range from about 300 to 2500 and preferably in the range 400 to 1500.

The esterified polyglycols of this invention can be made by several different methods. The different methods of forming the esters of hydroxyl-containing compounds can be found in "Advanced Organic Chemistry" by Jerry March (McGraw-Hill) 1968, pages 319 and 320. This reference is incorporated by reference herein. One method is to react the hydroxyl-terminated polyglycol with an acid chloride such as trifluoracetyl chloride to form the trifluoracetate ester. Another method is to react the hydroxyl terminated polyglycols with an anhydride such as acetic anhydride to form the acetate ester terminal group.

Preparation of a partially esterified polyol

Polyglycol P2000 (100.9 g) and 30.4 g of acetic anhydride were added into a 250 ml, three neck, round bottom flask fitted with a heating mantle, stirrer, thermometer, condenser and nitrogen purge. The system was purged for five minutes with nitrogen and stirred before starting to heat the mixture. The mixture was then heated to 90° C. and refluxed for four hours. The mixture was cooled and transferred to a 250 ml one neck round bottom flask and placed on a rotary evaporator. The product was subjected to 110° C. and 30 in. Hg vacuum for 1.5 hours to remove acetic acid and excess acetic anhydride. The product was cooled and transferred to a nitrogen padded bottle. The percent hydroxyl of the reaction product was analyzed to be 0.338% which is indicative of the fact that 76.6% of the hydroxyls had been capped.

The final lubricant compositions of this invention may contain effective amounts of ashless additives, such as antioxidants, corrosion inhibitors, metal deactivators, lubricity additives, extreme pressure additives and viscosity modifiers as may be required.

Examples of useful ashless antioxidants which can be used herein are phenyl naphthylamines, i.e., both alpha and beta-naphthyl amines; diphenyl amine: iminodibenzyl; p,p-dibutyl-diphenylamine: p,p'-dioctyldiphenylamine; and mixtures thereof. Other suitable antioxidants are hindered phenolics such as 2-t-butylphenol, 2,6-di-t-butylphenol and 4-methyl-2,6-di-t-butylphenol and the like.

Examples of suitable ashless metal corrosion inhibitors are commercially available, such as Irgalube 349 from Ciba-Geigy. This inhibitor compound is an aliphatic amine salt of phosphoric acid monohexyl ester. Other useful metal corrosion inhibitors are NA-SUL DTA and NA-SUL EDS from the White Chemical Company (diethylenetriamine dinonylnapthalene sulfonate and ethylene diamine dinonylnaphthalene sulfonate) and N-methyl oleosarcosine, respectively.

Examples of suitable ashless cuprous metal deactivators are imidazole, benzimidazole, pyrazole, benzotriazole, tolutriazole, 2-methyl benzimidazole, 3,5-dimethyl pyrazole, and methylene bis-benzotriazole.

Examples of suitable viscosity modifiers are pentaeryritol tetrapelargonate and trimethyolpropane triheptonate.

An effective amount of the foregoing additives for use in a air conditioning compressor is generally in the range from 0.1 to 5.0% by weight for the antioxidants, 0.1 to 5.0% by weight for the corrosion inhibitors, 0.001 to 0.5 percent by weight for the metal deactivators and 1 to 49% for the viscosity modifiers . The foregoing weight percentages are based on the total weight of the polyether polyols. It is to be understood that more or less of the additives may be used depending upon the circumstance for which the final composition is to be used.

Determination of the upper solution critical temperatures (USCT) for esterified polyglycols The selected esterified polyether polyol or control is vacuum stripped. Glass ampules are washed with acetone and vacuum dried at 110° C. The empty ampule is weighed and the sample to be evaluated is syringed into the tube. The tube is re-weighed to determine the weight of lubricant. The tube is evacuated to remove the air and then immersed in a dry ice/methylene chloride slurry contained in a Dewar Flask. The R134a is transferred at a pressure of 8 psig into the tube to give the desired lubricant concentration. The filled ampule was then disconnected and allowed to equilibrate at 25° C. The ampules were placed in a controlled temperature bath and the temperature varied from −10 to 95° C. Temperatures above 95° C. were not investigated because of pressure limitations of the glass ampule apparatus. Systems with USCT's above this temperature limit are denoted as greater than 95° C.

Several examples of the present invention and control runs with the refrigerant R134a are given in the following table.

R134a Upper Solution Critical Temperature Data

| | Polyol Functionality | Polyol Mol. Wt. | Ester | % Capping | Viscosity at 100° F. | Viscosity at 210° F. | % Lube in R134a | USCT |
|---|---|---|---|---|---|---|---|---|
| Ex 1 | 1 | 910 | Acetate | 99 | 38 | 7.9 | 14.5 | 85 |
| Cntl 1 | 1 | 910 | 0 | 0 | 43 | 8.3 | 16.6 | 70 |
| Ex. 2 | 2 | 1000 | Acetate | 90 | 56 | 9.7 | 15.7 | 90 |
| Cntl 2 | 2 | 1000 | 0 | 0 | 75 | 10.8 | 25.0 | 70 |
| Ex 3 | 2 | 1200 | Acetate | 90 | ND | ND | 13.8 | 82 |
| Cntl 3 | 2 | 1200 | 0 | 0 | 91 | 13.5 | 9.8 | 62 |
| Ex 4 | 2 | 2000 | Acetate | 77 | 140 | 22.1 | 10.4 | 47 |
| Ex 5 | 2 | 2000 | Propionate | 77 | 141 | 22.9 | 11.7 | 45 |
| Cntl 4 | 2 | 2000 | 0 | 0 | 160 | 23 | 12.4 | <25 |
| Ex 6 | 3 | 700 | Acetate | 61 | 63 | 8.1 | 15.1 | >95 |
| Cntl 5 | 3 | 700 | 0 | 0 | 108 | 10.5 | 11.8 | 82 |
| Cntl 6 | 3 | 700 | Benzoate | 22 | ND | ND | 12.4 | <25 |
| Ex 7 | 4 | 500(#) | Acetate | 64 | 48 | 6.1 | 17.7 | >95 |
| Cntl 7 | 4 | 500(#) | 0 | 0 | 119 | 19.4 | 10.8 | <25 |
| Cntl 8 | NA | NA | NA | NA | 96 | 13.9 | 13 | 35 |

where # is (PEP 550) from the BASF Corporation

Example 1 is a n-butanol initiated polyoxypropylene polyol of 910 molecular weight acetate ester with 99% of the hydroxyl groups capped with acetate groups and a 15 degree C. improvement in the USCT over the polyglycol precursor, Control 1.

Control 1 is a n-butanol initiated polyoxypropylene polyol of 910 molecular weight.

Example 2 is a propylene glycol initiated polyoxypropylene polyglycol of 1000 molecular weight acetate ester with a 20 degree C. improvement in the USCT over the polyglycol precursor, Control 2.

Control 2 is a propylene glycol initiated polyoxypropylene polyglycol of 1000 molecular weight.

Example 3 is a propylene glycol initiated polyoxypropylene polyglycol of 1200 molecular weight acetate ester with a 20 degree C. improvement in the USCT over the polyglycol precursor, Control 3. The viscosities at 100° F. and 210° F. were not determined and this is shown in the table as (ND).

Control 3 is a propylene glycol initiated polyoxypropylene polyglycol of 1200 molecular weight.

Example 4 is a propylene glycol initiated polyoxypropylene polyglycol of 2000 molecular weight acetate ester with a greater than 20 degree C. improvement in the USCT over the polyglycol precursor, Control 4.

Control 4 is a propylene glycol initiated polyoxypropylene polyglycol of 2000 molecular weight.

Example 5 is a propylene glycol initiated polyoxypropylene polyglycol of 2000 molecular weight propionate ester with a greater than 20 degree C. improvement in the USCT over the polyglycol precursor, Control 4.

Example 6 is a glycerine initiated polyoxypropylene polyglycol of 700 molecular weight acetate ester with greater than 13 degree C. improvement in the USCT over the polyglycol precursor, Control 5.

Control 5 is a glycerine initiated polyoxypropylene polyglycol of 700 molecular weight.

Control 6 is a glycerine initiated polyoxypropylene polyglycol of 700 molecular weight benzoate ester and shows that benzoate esters are not effective at increasing the USCT's of polyglycols. The viscosities at 100° F. and 210° F. were not determined (ND).

Example 7 is a pentaerythritol initiated polyoxypropylene polyglycol of 500 molecular weight acetate ester with a greater than 70 degree C. improvement in the USCT over the polyglycol precursor, Control 7.

Control 7 is a pentaerythritol initiated polyoxypropylene polyglycol of 500 molecular weight.

Control 8 is a 70/30 blend of P-2000 polyglycol and Mobil P-51 ester. The esterified polyether polyols of the present invention are superior to blends of polyglycols and esters as disclosed in U.S. Pat. No. 4,851,144 because the esterified polyether polyols have less percent ester moieties and surprisingly, have higher upper solution critical temperature values. For example, control 8 has 9.5 % ester groups and a USCT of 35° C. whereas example 4 of the present invention has 3.3 % ester groups and a USCT of 47° C. and example 1 of the present invention has 4.6 % ester groups and a USCT of 85° C.

The esterified polyglycols of the present invention also exhibit good solubility and would find utility with related hydrofluorocarbons and hydrochlorofluorocarbons such as 1,1,2,2-tetrafluoroethane, 1,1,1-trifluoroethane, 1,1-difluoroethane, trifluoromethane, methylene fluoride, difluorethylene, pentafluoroethane, chlorodifluoromethane, chlorofluoromethane, 2,2-dichloro-1,1,1-trifluoroethane, 1-chloro-1,2,2,2-tetrafluoroethane, 2-chloro-1,1,2,2-tetrafluoroethane, 1-chloro-2,2,2trifluoroethane, 1,1-dichloro-1-fluoroethane and 1-chloro-1,1-difluoroethane.

We claim:

1. Fluid compositions for use in compression refrigeration which have an upper solution critical temperature equal to or greater than about 35° C. comprising (A) a refrigerant selected from the group consisting of hydrofluorocarbons and hydrochlorofluorocarbons and (B) a lubricant composition which comprises polyether polyols or polyether alcohols which have a viscosity between 25 and 150 centistokes at 38° C. and where greater than about 30% of the hydroxyl groups of said polyols or alcohols are esterified wherein said esterified polyether polyols or polyether alcohols have the formula $$Z—[(CH_2—CH(R_1)—O—)_n—(CH_2—CH_3)—O—)_m—R_2]_p$$

where

Z is the residue of a compound having 1–8 active hydrogens, $R_1$ is hydroqen, ethyl, or mixtures thereof, $R_2$ is an alkanoyl group of 2 to 6 carbon atoms or hydrogen, n is 0 or a positive number, m is a positive number, n+m is a number having a value which will give an esterified polyether polyol or polyether alcohol with a number average molecular weight range from about 400 to about 2500, p is an integer having a value equal to the number of active hydrogens of Z.

2. The composition of claim 1 where greater than about 60% of the hydroxyl groups are esterified.

3. The composition of claim 1 where about 95 to about 100% of the hydroxyl groups are esterified.

4. The composition of claim 1 wherein said fluid composition contains a concentration of about 1 to about 75% by weight of lubricant composition.

5. The composition of claim 1 wherein said hydrochlorofluorocarbons are selected from the group consisting of chlorodifluoromethane, chlorofluoromethane, 2,2-dichloro-1,1,1-trifluoroethane, 1-chloro-1,2,2,2-tetrafluoroethane, 2-chloro-1,1,2,2-tetrafluoroethane, 1-chloro-2,2,2-trifluoroethane. 1,1-dichloro-1-fluoroethane and 1-chloro-1,1-difluoroethane.

6. The composition of claim 1 wherein said hydrofluorocarbons are selected from the group consisting of 1,1,1,2-tetrafluoroethane, 1,1,2,2-tetrafluoroethane, 1,1,1-trifluoroethane, 1,1-difluoroethane, trifluoromethane, methylene fluoride, methyl fluoride, difluorethylene and pentafluoroethane.

7. The composition of claim 1 where Z is the residue of a compound having 1–4 active hydrogens.

8. Fluid compositions for use in compression refrigeration which have an upper solution critical temperature equal to or greater than about 35° C. comprising (A) a refrigerant selected from the group consisting of hydrofluorocarbons and hydrochlorofluorocarbons and (B) a lubricant composition which comprises polyether polyols or polyether alcohols which have a viscosity between 25 and 150 centistokes at 38° C. and where greater than about 30% of the hydroxyl groups of said polyols or alcohols are esterified wherein said esterified polyether polyols or polyether alcohols have the formula $$Z—[(CH_2—CH(CH_3)—O—)_n—R_1]_p$$

where

Z is the residue of a compound having 1–8 active hydrogens, $R_1$ is an alkanoyl group of 2 to 6 carbon atoms or hydrogen, n is a number having a value which will give an esterified polyether polyol or polyether alcohols with a number average molecular weight range from about 400 to about 2500, p is an integer having a value equal to the the number of active hydrogens of Z.

9. The composition of claim 8 where greater than about 60% of the hydroxyl groups are esterified.

10. The composition of claim 8 where about 95 to about 100% of the hydroxyl groups are esterified.

11. The composition of claim 8 wherein said fluid composition contains a concentration of about 1 to about 75% by weight of lubricant composition.

12. The composition of claim 8 wherein said hydrochlorofluorocarbons are selected from the group consisting of chlorodifluoromethane, chlorofluoromethane, 2,2-dichloro-1,1,1-trifluoroethane, 1-chloro-1,2,2,2-tetrafluoroethane, 2-chloro-1,1,2,2-tetrafluoroethane, 1-chloro-2,2,2-trifluoroethane, 1,1-dichloro-1-fluoroethane and 1-chloro-1,1-difluoroethane.

13. The composition of claim 8 wherein said hydrofluorocarbons are selected from the group consisting of 1,1,1,2-tetrafluoroethane, 1,1,2,2-tetrafluoroethane, 1,1,1-trifluoroethane, 1,1-difluoroethane, trifluoromethane, methylene fluoride, methyl fluoride, difluoroethylene and pentafluoroethane.

14. The composition of claim 8 where Z is the residue of a compound having 1–4 active hydrogens.

15. Fluid compositions for use in compression refrigeration which have an upper solution critical temperature equal to or greater than about 35° C. comprising (A) 1,1,1,2-tetrafluoroethane and (B) a lubricant composition which comprises polyether polyols or polyether alcohols which have a viscosity between 25 and 150 centistokes at 38° C. and where greater than about 30% of the hydroxyl groups of said polyols or alcohols are esterified wherein said esterified polyether polyols or polyether alcohols have the formula $$Z—[(CH_2—CH(CH_3)—O—)_n—R_1]_p$$

where

Z is the residue of a compound having 1–8 active hydrogens, $R_1$ is an alkanoyl group of 2 to 6 carbon atoms or hydrogen, n is a number having a value which will give an esterified polyether polyol or polyether alcohols with a number average molecular weight range from about 400 to about 2500, p is an integer having a value equal to the number of active hydrogens of Z.

16. The composition of claim 15 where greater than about 60% of the hydroxyl groups are esterified.

17. The composition of claim 15 where about 95 to about 100% of the hydroxyl groups are esterified.

18. The composition of claim 15 wherein said fluid composition contains a concentration of about 1 to about 75% by weight of lubricant composition.

19. The composition of claim 15 wherein said hydrochlorofluorocarbons are selected from the group consisting of chlorodifluoromethane, chlorofluoromethane, 2,2-dichloro-1,1,1-trifluoroethane, 1-chloro-1,2,2,2-tetrafluoroethane, 2-chloro-1,1,2,2-tetrafluoroethane, 1-chloro-2,2,2-trifluoroethane, 1,1-dichloro-1-fluoroethane and 1-chloro-1,1-difluoroethane.

20. The composition of claim 15 wherein said hydrofluorocarbons are selected from the group consisting of 1,1,1,2-tetrafluoroethane, 1,1,2,2-tetrafluoroethane, 1,1,1-trifluoroethane, 1,1-difluoroethane, trifluoromethane, methylene fluoride, methyl fluoride, difluorethylene and pentafluoroethane.

21. The composition of claim 15 where Z is the residue of a compound having 1–4 active hydrogens.

22. A fluid composition for use in compression refrigeration comprising (A) 1,1,1,2-tetrafluoroethane, and (B) a polypropylene glycol having a number average molecular weight of from about 400 to about 1500 with about 95% or more of the free hydroxyl groups esterified with alkanoyl groups of 2 to 6 carbon atoms.

23. A fluid composition as set forth in claim 22 wherein said alkanoyl groups are selected from the group consisting of acetate and propionate groups.

24. A method of lubricating and/or operating compression refrigeration equipment which comprises circulating the composition of claim 1, 2, 3, 4, 5, 6, 7, 8, 9, 10, 11, 12, 13, 14, 15, 16, 17, 18, 19, 20, 21, 22 or 23 through said compression refrigeration equipment.

* * * * *

UNITED STATES PATENT AND TRADEMARK OFFICE

CERTIFICATE OF CORRECTION

PATENT NO. : 4,959,169

DATED : September 25, 1990

INVENTOR(S) : Philip W. McGraw, Eldon L. Ward, and Michael W. Edens

It is certified that error appears in the above-identified patent and that said Letters Patent is hereby corrected as shown below:

Col. 4, line 18, change the colon to a semicolon.

Col. 4, line 19, the colon to a semicolon.

Col. 6, line 59, change "fluoride, difluorethylene" to read --fluoride, methyl fluoride difluorethylene--.

Col. 6, line 63, change "2,2,2trifluoroethane" to read --2,2,2-trifluoroethane--.

Signed and Sealed this

Eighth Day of June, 1993

*Attest:*

Michael K. Kirk

MICHAEL K. KIRK

*Attesting Officer*

*Acting Commissioner of Patents and Trademarks*